US008624748B1

(12) United States Patent
Grasty, Jr.

(10) Patent No.: US 8,624,748 B1
(45) Date of Patent: Jan. 7, 2014

(54) FLOATING ROOF MONITORING SYSTEM

(75) Inventor: James Stuart Grasty, Jr., Waynesville, NC (US)

(73) Assignee: Alltec Corporation, Canton, NC (US)

( * ) Notice: Subject to any disclaimer, the term of this patent is extended or adjusted under 35 U.S.C. 154(b) by 193 days.

(21) Appl. No.: 13/084,079

(22) Filed: Apr. 11, 2011

(51) Int. Cl.
*G08B 21/00* (2006.01)
*H02H 3/00* (2006.01)

(52) U.S. Cl.
USPC ..... 340/649; 340/540; 340/635; 340/657; 361/1

(58) Field of Classification Search
USPC ..... 340/649, 635, 657–664; 361/1
See application file for complete search history.

(56) References Cited

U.S. PATENT DOCUMENTS

| | | | | |
|---|---|---|---|---|
| 3,942,674 | A * | 3/1976 | Nelson | 220/221 |
| 4,649,374 | A * | 3/1987 | Hoigaard | 340/573.1 |
| 6,127,934 | A * | 10/2000 | Powell et al. | 340/649 |
| 6,896,779 | B2 * | 5/2005 | Thomas et al. | 204/404 |
| 6,930,612 | B1 * | 8/2005 | Kraz et al. | 340/649 |
| 7,078,621 | B1 | 7/2006 | Carpenter, Jr. et al. | |
| 2005/0098560 | A1 * | 5/2005 | Hamer et al. | 220/222 |
| 2007/0205907 | A1 * | 9/2007 | Schenk, Jr. | 340/623 |
| 2012/0073367 | A1 * | 3/2012 | Tzonev et al. | 73/305 |

* cited by examiner

*Primary Examiner* — George Bugg
*Assistant Examiner* — Munear Akki
(74) *Attorney, Agent, or Firm* — Hope Baldauff, LLC

(57) ABSTRACT

A floating roof monitoring system is disclosed. According to embodiments, the floating roof monitoring system includes a monitoring device and a floating roof tank. The monitoring device can generate a current for a monitoring loop that includes one or more electrical connections between the monitoring device and the floating roof tank. A resistance value for one or more points within or along the monitoring loop can be determined and monitored. The monitoring device can determine, based upon the resistance value, if an action is to be taken.

20 Claims, 4 Drawing Sheets

FLOATING ROOF MONITORING SYSTEM

BACKGROUND

Flammable liquids such as gasoline, oil, and alcohol can be stored in floating roof tanks. Floating roof tanks are usually installed for environmental or economical reasons to limit product loss and reduce the emission of volatile organic compounds. Additionally, floating roof tanks sometimes are used to store flammable liquids because fumes of such materials can pose extreme risks of fire and/or explosion. Floating roof tanks therefore may be used to reduce the exposed surface area and reduce the vapor space of the flammable liquids, thereby reducing the risk of fires and/or explosions.

Lightning and/or other electrical discharges at or near the floating roof tanks, however, pose a serious risk of fire and/or explosion if the discharge ignites the fumes of the flammable liquids. This risk is particularly high at or near the rim of the floating roof of floating roof tanks, as an air gap typically exists between the floating roof and the shell of the floating roof tank. In fact, rim seal fires are the most common type of fire in floating roof tanks, particularly external floating roof tanks.

To mitigate the risk of rim seal fires, it is common to equip floating roof tanks with shunts around the rim of the floating roof. The shunts are spring loaded wiping contacts that engage the shell, thereby creating an electrical connection between the floating roof and the shell. The shell typically is connected to a grounding system, and therefore the floating roof can be grounded using shunts or other electrical connections between the floating roof and the shell. Thus, the threat of rim seal fires caused by electrical arcing or other electrical discharges between the floating roof and the shell can be reduced if the shunts and shells are maintained in working order.

The shunts, however, tend to wear out over time. Similarly, sludge and/or other materials can accumulate along the wall of the shell, preventing or degrading electrical connections between the shunts and the shell. As such, maintenance of floating roof tanks often includes inspection and/or repair of shunts, if the shunts are visible. Because shunts sometimes are submerged in the flammable liquids held by the floating roof tanks, such an inspection may be difficult if not impossible without first draining the floating roof tanks. Thus, data indicates that proper inspections of shunts and/or other floating roof tank structures may be properly performed as rarely as once every ten years. As such, these and other maintenance procedures may be inadequate for detecting degrading shunts and/or other structures, and therefore may fail to reduce the risk of rim seal fires.

It is with respect to these and other considerations that the disclosure made herein is presented.

SUMMARY

The present disclosure is directed to a floating roof monitoring system. According to some embodiments of the concepts and technologies disclosed herein, a floating roof monitoring system includes a monitoring device and a floating roof tank. The monitoring device can generate a current for a monitoring loop that includes one or more electrical connections between the monitoring device and the floating roof tank. A resistance value for one or more points within or along the monitoring loop can be determined and monitored. The monitoring device can determine, based upon the resistance value, if an action is to be taken.

According to an aspect, a floating roof monitoring system includes a monitoring device, a remote input/output ("I/O") device, a floating roof tank, and a grounding bar or other grounding system. The monitoring device generates a current, which can be an intrinsically safe current, for a monitoring loop that includes the floating roof tank, the grounding device, and the remote I/O device and/or the monitoring device. A resistance for one or more points along the monitoring loop can be measured. The measured resistance can be compared to an expected resistance associated with the monitoring loop.

If the measured resistance varies from the expected resistance value, the difference can be determined and compared to one or more threshold values. Similarly, a rate at which the measured resistance value and the expected resistance value diverge can be determined and compared to one or more threshold values. If a threshold is met, exceeded, or failed to be met or exceeded, the monitoring device and/or other systems or devices can take action to notify entities or personnel of the condition associated with the monitoring loop and/or take other actions.

According to various embodiments, the monitoring device is an analog or a digital device. In some embodiments, the functionality of the monitoring device is provided by hardware components or modules associated with the monitoring device. In other embodiments, the functionality of the monitoring device is provided by execution of one or more software modules by the monitoring device. In yet other embodiments, the monitoring device includes a combination of hardware and/or software modules that are configured to analyze and/or monitor analog and/or digital signals.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
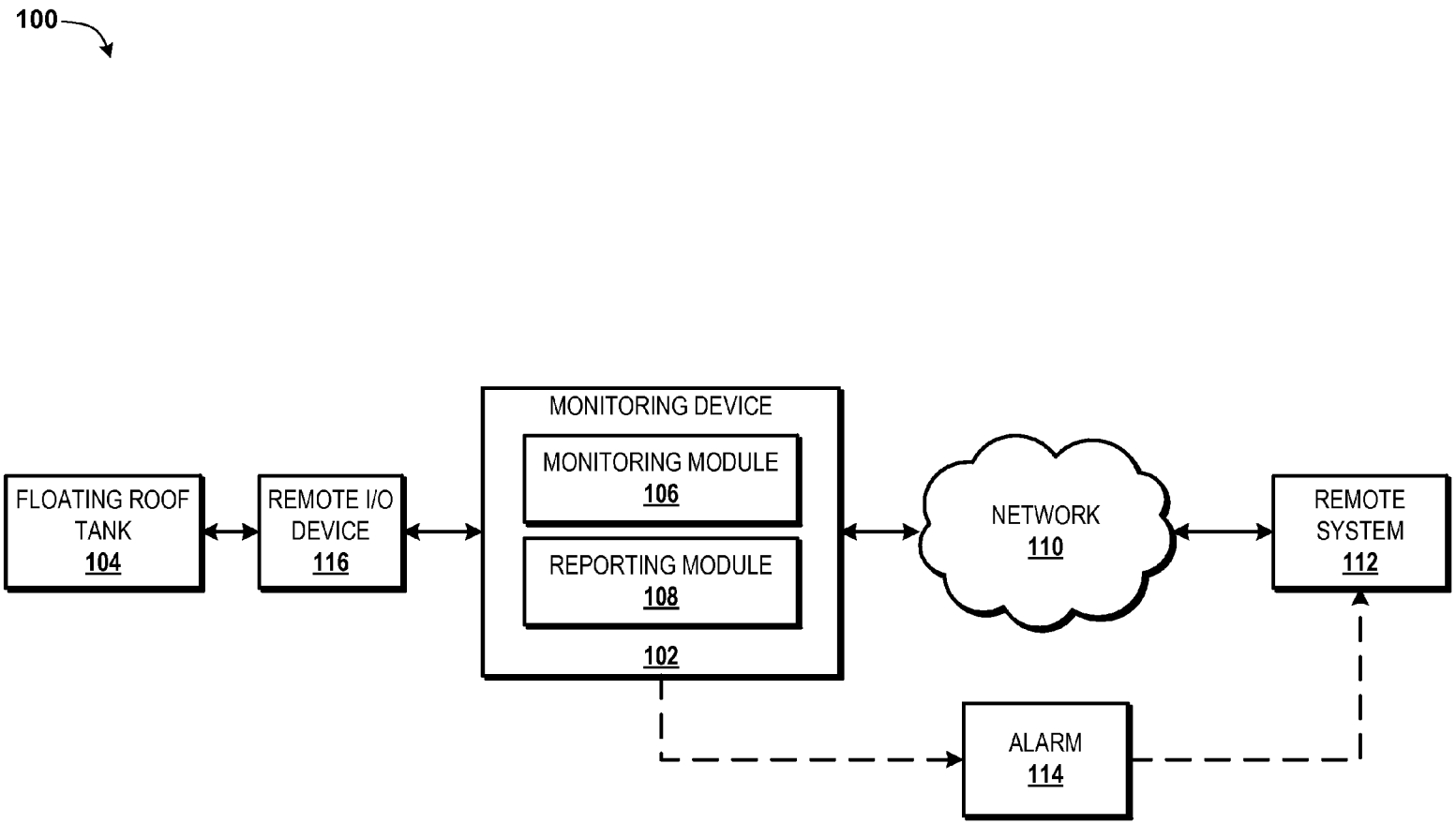
FIG. 1 is a block diagram illustrating a floating roof monitoring system, according to one embodiment.

The following detailed description is directed to a floating roof monitoring system. The floating roof monitoring system includes, in some embodiments, a monitoring device, a remote input/output ("I/O") device, a floating roof tank, and a grounding bar or other grounding system. The floating roof monitoring system also can include one or more networks and/or one or more connections to one or more networks. The monitoring device is configured to generate a current, which can be an intrinsically safe current. The current can be generated for a monitoring loop that includes the floating roof tank, the grounding device, and the monitoring device. In some embodiments, the monitoring loop further can include the remote I/O device. A resistance for one or more points along the monitoring loop can be measured. The measured resistance can be compared to an expected resistance associated with the monitoring loop.

The monitoring device can further be configured to determine a difference between the measured resistance value and the expected resistance value. The difference can be compared to one or more threshold values associated with the difference. Similarly, a rate at which the measured resistance value and the expected resistance value diverge or converge can be determined and can be compared to one or more threshold values. If a threshold is met, exceeded, or failed to be met or exceeded, the monitoring device and/or other systems or devices can take action to notify entities or personnel of the condition associated with the monitoring loop and/or to take other actions. These and other aspects of the concepts and technologies disclosed herein will be described below in more detail.

In the following detailed description, references are made to the accompanying drawings that form a part hereof, and in which are shown by way of illustration specific embodiments or examples. It must be understood that the disclosed embodiments are merely exemplary of the concepts and technologies disclosed herein. The concepts and technologies disclosed herein may be embodied in various and alternative forms, and/or in various combinations of the embodiments disclosed herein.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a floating roof monitoring system will be presented.

Referring now to FIG. 1, aspects of a floating roof monitoring system 100 according to various embodiments presented herein will be described. The floating roof monitoring system 100 shown in FIG. 1 includes a monitoring and reporting device ("monitoring device") 102. According to various embodiments, the functionality of the monitoring device 102 is provided by a server computer, a desktop computer, a laptop computer, an embedded control system, a handheld computer, or other computing devices.

According to some embodiments, the functionality of the monitoring device 102 is provided by an embedded control system configured to execute instructions to provide the functionality described herein for monitoring a floating roof tank. In other embodiments, the functionality of the monitoring device 102 is provided by a computing system configured to execute an operating system and one or more application programs to provide the functionality described herein for monitoring a floating roof tank 104. For example, the functionality of the monitoring device 102 can be provided by an analog and/or digital computing device that includes and/or is configured to execute one or more hardware or software modules.

In some embodiments, the functionality of the monitoring device 102 is provided by a computing system such as a computer or embedded control system configured to execute a reporting module 106 to generate, to loop to and through the floating roof tank 104, to receive, and to analyze analog and/or digital signals to test and/or otherwise monitor the floating roof tank 104, as will be explained in more detail below. Additionally, or alternatively, various embodiments of the monitoring device 102 can include a computing system configured to execute a reporting module 108 to provide the functionality described herein for reporting detected conditions associated with the floating roof tank 104. It should be understood that these embodiments are illustrative, and should not be construed as being limiting in any way.

In other embodiments, the functionality of the monitoring device 102 is provided by a device configured to provide, via various relays, disconnects, and/or other hardware, the functionality described herein. Thus, in some embodiments, the monitoring module 106 and/or the reporting module 108 can be provided by a combination of various hardware elements to provide the functionality disclosed herein for monitoring a floating roof tank 104. Thus, while not explicitly shown in FIG. 1, the monitoring device 102 can include various combinations of hardware elements such as analog-to-digital converters ("ADCs"); direct current ("DC") or alternating current ("AC") power supplies such as hardwire connections, battery connections, solar power connections, and/or other power source connections; surge protection; fuses and/or breakers or interrupts; digital-to-analog converters ("DACs"); gates; relays; light-emitting-diodes ("LEDs") and/or other visual indicators or displays; vibrating alerts and/or other tactile indicators; speakers and/or other sound sources; wireless and/or wired network connections; receivers, transmitters, and/or transceivers; resistors; potentiometers; capacitors; batteries; filters; diodes; registers; switches; terminal blocks; combinations thereof, and the like.

The monitoring device 102 may operate on or in communication with a network 110. The network 110 can include any combination of one or more wired and wireless networks including, but not limited to, cellular networks and packet data networks such as the Internet, local area networks (LANs), wide area networks (WANs), and/or other public and/or private networks. Additionally, or alternatively, the monitoring device 102 may operate in conjunction with other computing systems on or in communication with the network 110. In some embodiments, for example, the monitoring device 102 communicates via analog and/or digital signaling with a remote system 112 or other devices or systems operating on or in communication with the network 110. The remote system 112 can include, for example, an analog or digital computing device provided by or associated with one or more of a monitoring service; management and/or emergency personnel; maintenance personnel; an emergency service such as a fire department, emergency response personnel; and/or other systems, devices, networks, personnel, or other entities.

According to some embodiments, the monitoring device 102 communicates an operating state or other operation data to the remote system 112, wherein the remote system 112 functions as a monitoring service. In other embodiments, the monitoring device 102 communicates an alarm 114 or other operation or state information to the remote system 112. Thus, it should be understood that in various implementations, a level of communications between the monitoring device 102 and the remote system 112 can be varied or eliminated. It should be understood that the remote system 112 is optional, and is not included in all embodiments of the floating roof monitoring system 100.

In some embodiments, the floating roof monitoring system 100 also includes a remote input/output ("I/O") device 116. While the monitoring device 102 and the remote I/O device 116 are illustrated separately, it should be understood that this is not necessarily the case. More particularly, in some embodiments, the functionality of the monitoring device 102 and the remote I/O device 116 are provided by or within a single device. Thus, the illustrated embodiment is illustrative, and should not be construed as being limiting in any way.

The remote I/O device 116 is configured to provide a remote connection point for wires, cables, and/or other hardware used to provide a monitor loop or a ground loop between the monitoring device 102 and the floating roof tank 104. In particular, the remote I/O device 116 may be configured as an explosion proof device that is safe within various distances of the floating roof tank 104. In some embodiments, for example, the remote I/O device 116 is configured to comply with ATmospheres EXplosibles ("ATEX") Zone 1 and/or Zone 0 requirements and/or with the National Electrical Code ("NEC") Class I, Division I application requirements. Similarly, the monitoring device 102 can be configured to comply with ATEX Zone 1 requirements, if desired, to allow use of the monitoring device 102 within various distances of the floating roof tank 104. It should be understood that the remote I/O device 116 and/or the monitoring device 102 can be built according to other requirements and/or guidelines. Thus, these embodiments should be understood as being illustrative and should not be construed as being limiting in any way.

As will be described in more detail herein, the remote I/O device 116 can be used to provide a remote connection point for input and output connections to and from the floating roof tank 104, and to provide a remote connection point for input and output connections to and from the monitoring device 102. Thus, the remote I/O device 116 can be used to route an intrinsically safe current from the monitoring device 102 to the floating roof tank 104. In some embodiments, the intrinsically safe current has a maximum amperage of about 0.410 Amps (410 milliAmps). In other embodiments, the intrinsically safe current has a maximum Amperage of about 500 milliamps, 1 Amp, more than 1 Amp, or less than 1 Amp. It should be understood that these embodiments are illustrative, and should not be construed as being limiting in any way.

As will be explained in more detail herein, the intrinsically safe current is routed to the floating roof tank 104, to the floating roof of the floating roof tank 104, and from the floating roof into the wall or shell of the floating roof tank 104. The intrinsically safe current can be routed from the shell to a ground bus bar or other grounded structure, from the grounded structure back to the remote I/O device 116, and from the remote I/O device back to the monitoring device 102. Thus, according to various embodiments a complete circuit referred to herein as a ground loop or monitoring loop can be created between and including the monitoring device 102 and the floating roof tank 104 via the remote I/O device 116. As mentioned above, the remote I/O device 116 can be omitted or incorporated into the monitoring device 102, if desired.

According to various embodiments the routed current has known attributes, and therefore a resistance can be accurately measured at a suitable measurement location. In some implementations, the resistance is measured at the shell of the floating roof tank 104. An expected resistance value can be known or can be calculated for the floating roof tank 104, and the actual resistance measured at any time can be compared to the expected resistance value. The resistance at the measurement location ("measured resistance") can be determined or received by the monitoring device 102. Any difference between the measured resistance value and the expected resistance value can be compared to one or more threshold resistance values set, maintained, and/or determined by the monitoring device 102. Additionally, or alternatively, a resistance deviation rate can be monitored and compared to a threshold resistance deviation rate set, maintained and/or determined by the monitoring device 102. If a measured resistance value deviates or begins to diverge from an expected resistance value, the deviation and/or the rate at which the two values are diverging or deviating from one another can be compared to a threshold value and/or threshold rate. In some embodiments, the monitoring device 102 compares the measured resistance value to the expected resistance value, and determines a deviation and deviation rate.

More particularly, the monitoring device 102 and/or the remote I/O device 116 can be configured with a threshold resistance deviation value or a threshold resistance deviation rate. The threshold resistance deviation value can be a number of Ohms, or numbers of portions thereof, above some base resistance measure determined or set as the expected resistance value associated with the floating roof tank 104. The base resistance measure can correspond to a historical or trend value associated with the floating roof tank 104, a value determined at installation of the monitoring device 102 or at another time, and/or another value. It should be understood that the base resistance measure can vary among floating roof tanks 104, and that therefore reference to any specific value set as a default threshold may be substituted or supplemented with a value determined for a particular floating roof tank 104.

The threshold resistance deviation value can be set by users, manufacturers, installers, and/or other authorized entities, or can be determined by the monitoring device 102 or other devices, based upon current and/or historical environmental, weather, and/or equipment conditions. For example, the threshold resistance deviation value may change over time due to degrading shunts on the floating roof tank 104, buildup of sludge or other intervening materials between the shunts and the shell of the floating roof tank 104, and the like. Similarly, the threshold resistance deviation value can be changed based upon weather and/or environmental conditions at a particular time, or activities occurring at the floating roof tank 104. For example, if a thunderstorm occurs near the floating roof tank 104, the threshold resistance deviation value may be reduced relative to the normal value of the threshold resistance deviation value, as the threat of a lightning discharge at or near the floating roof tank 104 may be elevated relative to a threat of lightning discharge under normal operating conditions. Similarly, during pumping of liquids into or out of the floating roof tank 104, the threat may be deemed to be elevated. Thus, a threshold resistance deviation value may be reduced or otherwise modified such that remedial steps can more quickly be taken in the event that the measured resistance value begins to increase or otherwise change. It should be understood that these embodiments are illustrative, and should not be construed as being limiting in any way.

In one embodiment, the threshold resistance deviation value is set to 10 ohms above a base resistance value. In other embodiments, the threshold resistance deviation value is set to a value in a range of 1 to 10 Ohms above a base resistance value, a value in a range of 10 to 20 Ohms above a base resistance value, or various values below 1 Ohm above a base resistance value or above 20 Ohms over a base resistance value. The threshold resistance deviation value can be set to any value determined to be suitable by the manufacturers, installers, and/or maintenance, security, or engineering personnel, or determined by various devices or software including, but not limited to, the monitoring device 102. Thus, it should be understood that the above-mentioned threshold resistance deviation values are illustrative, and should not be construed as being limiting in any way.

The threshold resistance deviation rate also can be set by users, manufacturers, installers, and/or other authorized entities, and/or can be determined by the monitoring device 102 or other devices, based upon current or historical environmental, weather, and/or equipment conditions, as well as trends in measured resistance values. More particularly, in the event of an actual or predicted electrical storm, the value of the threshold resistance deviation rate may be changed with respect to the value of the threshold resistance deviation rate in other weather or environmental conditions. Similarly, the threshold resistance deviation rate can be modified based upon an elapsed time since maintenance of equipment associated with the floating roof tank 104, as equipment associated with the floating roof tank 104 ages, during or before anticipated activity occurring at the floating roof tank 104, and/or based upon other considerations. It should be understood that this embodiment is illustrative, and should not be construed as being limiting in any way.

In one embodiment, the threshold resistance deviation rate is set to a value of 1 Ohm per second. Thus, if the difference between the measured resistance value and the expected resistance value diverges from one another at a rate of 1 Ohm per second or faster, the threshold can be deemed to be satisfied irrespective of whether the threshold resistance deviation value is satisfied. In other embodiments, the threshold resistance deviation rate is set to a value in a range of 0.1 Ohms per millisecond to 1 Ohm per second, or various values below 0.1 Ohm per millisecond or above 1 Ohm per second. The threshold resistance deviation rate can be set to any value determined to be suitable by the manufacturers, installers, and/or maintenance, security, or engineering personnel, or determined by various devices or software including, but not limited to, the monitoring device 102. Thus, it should be understood that the above-mentioned threshold resistance deviation rates are illustrative, and should not be construed as being limiting in any way. Additional aspects of the floating roof monitoring system 100, as well as details of the floating roof tank 104, will be described in additional detail below with reference to FIGS. 2-4.

It should be understood that in some embodiments, failure to meet or exceed a threshold value or threshold rate can trigger various actions. For example, if a difference between the measured resistance value and the expected resistance value differs by less than a particular threshold value, or if a rate at which the two values converge, actions may be triggered as well. In particular, such a convergence or a failure to meet or exceed a threshold value may indicate that the base resistance value is or was incorrectly determined, or that a short circuit has occurred somewhere along the monitoring loop. Thus, for example, the monitoring system 102 may determine such a situation if the base resistance value is 5 Ohms, and a measured resistance value is 3.5 Ohms. Similarly, such a situation may indicate that an intervening insulator or other substance exists between a floating roof and a shell of the floating roof tank 104, thereby allowing measured resistance values to dip below expected resistance values as the floating roof travels up or down within the shell. These examples are illustrative, and should not be construed as being limiting, in any way, of situations in which failure to meet or exceed a threshold or other value may be used to trigger remedial action.

In some situations, a measured resistance value may meet, exceed, or fail to meet or exceed a threshold resistance value at a first time, and at a second time, the measured resistance value could drop below the threshold value or meet or exceed the threshold value. In these and other embodiments, time and/or date information can be recorded for the measured resistance value and recorded in a memory or other suitable data storage device. A count of such occurrences can be maintained by the monitoring device 102, and when a threshold number of such occurrences are counted, or when a threshold number of such occurrences within a defined time period are counted, the monitoring device 102 can determine that an alarm or report state exists and take an action as explained herein. In some embodiments, the monitoring system 102 determines that an alarm or report state exists based upon ten such occurrences within a twenty-four hour period, five such occurrences within a twenty-four hour period, ten such occurrences in a ten second period, and/or any other desired values. For the sake of clarity, FIG. 1 illustrates one monitoring device 102, one floating roof tank 104, one network 110, one remote system 112, and one remote I/O device 116. It should be understood, however, that some implementations of the floating roof monitoring system 100 may include multiple monitoring devices 102, multiple floating roof tanks 104, multiple networks 110, multiple remote systems 112, and/or multiple remote I/O devices 116. Therefore, the illustrated embodiment should be understood as being exemplary, and should not be construed as being limiting in any way.

Figure 2:
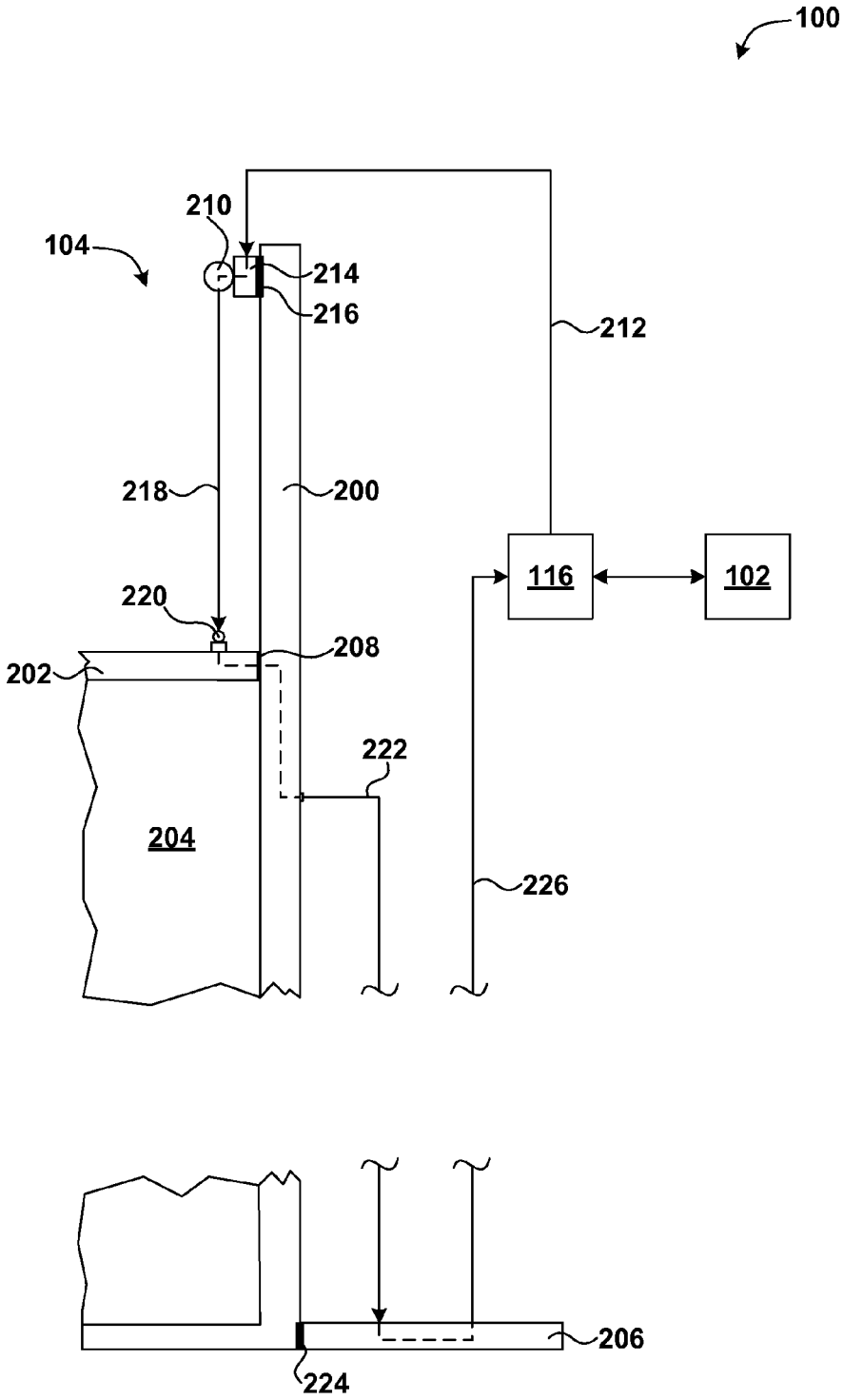
FIG. 2 is a line diagram illustrating an example implementation of a floating roof monitoring system, according to one embodiment.

Turning now to FIG. 2, additional aspects of the floating roof monitoring system 100 will be described in detail. In particular, FIG. 2 is a line diagram illustrating an example implementation of a floating roof monitoring system 100, according to some embodiments. As shown in FIG. 2, the floating roof tank 104 can include a wall structure or shell ("shell") 200 and a floating roof 202. The shell 200 can contain a fluid such as gasoline, oil, and the like ("fluid") 204, and the floating roof 202 can be disposed on top of the fluid 204 to cover the fluid 204 from the elements, to help reduce evaporation of the fluid 204, and for other purposes.

The shell 200 can be electrically connected or coupled to a grounding bar 206, which can be used to ground the floating roof tank 104 in an attempt to reduce vulnerability of the floating roof tank 104 to rim seal fires, to allow movement of an electrical charge from the floating roof tank 104 to the grounding bar 206, and/or for other purposes. In some embodiments, the shell 200 is grounded via electrical connections between the shell 200 and the grounding bar 206, and the floating roof 202 can be conductively connected to the shell 200 via one or more shunts, or the like. Because the functionality and structure of various types of shunts are known, the shunts are not illustrated or described herein in additional detail. Thus, although not visible in FIG. 2, the shunts can be disposed about the perimeter of the floating roof 202 at the interface point 208 illustrated in FIG. 2, along with a foam band and/or other structures or devices. It should be understood that the floating roof tank 104 and/or the shell 200 can be considered to be inherently grounded because of the size of the floating roof tank 104 and/or the type of material the floating roof tank 104 rests on. As such, some embodiments of the concepts and technologies disclosed herein can omit the grounding bar 206 and instead rely upon the shell 200 or other structures of the floating roof tank 104 for grounding. As such, it should be understood that the illustrated embodiments are illustrative, and should not be construed as being limiting in any way.

Over time, the shunts or other structures of the floating roof 202 and/or the shell 200 can break down, oxidize, and/or degrade. Thus, an electrical connection between the floating roof 202 and the shell 200 can be lost or degraded due to various conditions. According to embodiments of the concepts and technologies disclosed herein, the floating roof tank 104 is configured to allow monitoring of the electrical connection between the floating roof 202 and the shell 200.

In the illustrated embodiment, an intrinsically safe current is routed from the monitoring device 102 to a monitoring reel 210 located at or near the shell 200. According to various embodiments, the intrinsically safe current can be routed to the monitoring reel 210 via a cable or wire 212 originating at the monitoring device 102 or the remote I/O device 116. The cable or wire 212 can be electrically connected to the monitoring reel 210 and/or a wire or cable located within the monitoring reel 210.

Similarly, the connections between the monitoring device 102 and the remote I/O device 116, between the monitoring reel 210 and the floating roof 202, between the floating roof tank 104 and the grounding bar 206, and between the grounding bar 206 and the remote I/O device 116 or the monitoring device 102 can be provided by a cable or wire similar to the cable or wire 212. According to some implementations, the cable or wire 212 is a stainless steel wire with an insulating plastic, ceramic, or other material coating. In some embodiments, a steel wire or cable coated with HYTREL or another suitable insulating material is used. According to various implementations, the size or diameter of the cable or wire 212 is selected based, at least partially, upon anticipated requirements for mechanical integrity of the cable, and not based upon electrical properties, though this is not necessarily the case. It should be understood that this embodiment is illustrative, and should not be construed as being limiting in any way. In particular, the cable or wire 212 and/or other cables or wires used in the various embodiments disclosed herein can be made from any suitable conductive material, and the cable or wire 212 and or other cables or wires used in the various embodiments of the concepts and technologies disclosed herein can be coated, insulated, and/or otherwise treated with any suitable insulating material.

In the illustrated embodiment, the monitoring reel 210 is attached to the shell 200 via a mounting bracket 214 that is bolted, riveted, and/or otherwise attached to the shell 200. Structures or devices other than the mounting bracket 214 can be used to locate the monitoring reel 210 at or near the shell 200. According to various implementations of the concepts and technologies disclosed herein, the monitoring reel 210 is insulated or otherwise electrically isolated from the shell 200. For example, an insulation pad 216 or other insulating materials or structures can be disposed between the monitoring reel 210 or the mounting bracket 214 and the shell 200. Thus, it should be understood that the illustrated embodiment is illustrative, and should not be construed as being limiting in any way.

The monitoring reel 210 can be spring loaded or otherwise configured such that a monitoring wire 218 is retractably disposed at the monitoring reel 210. The monitoring wire 218 can be electrically connected to the monitoring reel 210 and/or the cable 212 such that the intrinsically safe current from the monitoring device 102 and/or the remote I/O device 116 can be provided to the monitoring wire 218. The monitoring wire 218 can be connected to a mounting bracket 220 or other structures or devices of, on, or at the floating roof 202. As explained above with reference to the cable or wire 212, the monitoring wire 218 can be an insulated cable or wire made from any suitable materials, and the size or diameter of the monitoring wire 218 can be, but is not necessarily, selected based, at least partially, upon anticipated requirements for mechanical integrity of the monitoring wire 218 as opposed to merely being based upon required electrical properties, though this is not necessarily the case.

The mounting bracket 220 can be attached or connected to the floating roof 202 via various means. In some embodiments, the mounting bracket 220 is welded to the floating roof 202 before the floating roof 202 is disposed on the fluid 204 and/or when the floating roof tank 104 is empty or filled with non-flammable materials. In other embodiments, a hydraulic punch or other suitable device is used to form connection apertures in the floating roof 202 into or through which various structures may be passed or connected. In other embodiments, holes are drilled into or through the floating roof 202. In yet other embodiments, conductive adhesives are used to attach the mounting bracket 220 to the floating roof 202. It should be understood that in various implementations, paint or oxidation may be removed from the roof 202 to provide a metal-to-metal connection between the mounting bracket 220 and the floating roof 202.

As mentioned above, the intrinsically safe current can be routed to the shell 200 via various structures of the floating roof tank 104 including, but not limited to, shunts or other sliding contacts, wires or cables, and/or other structures or devices. The intrinsically safe current can be routed into the grounding bar 206 or another earthing or grounding device via a ground wire 222. Additionally, or alternatively, the intrinsically safe current can be routed from the shell 200 to the grounding bar 206 via an attachment mechanism or attachment point 224 corresponding to a conductive coupling or connection between the shell 200 and the grounding bar 206. It should be understood that these embodiments are illustrative, as the intrinsically safe current can be routed into the grounding bar 206 via any suitable structures and/or devices.

The grounding bar 206 can be conductively coupled or connected to the remote I/O device 116 and/or the monitoring device 102 via a return path 226. Thus, the monitoring device 102 can send an intrinsically safe current to the floating roof tank 104 and monitor the current via the return path 226. It therefore can be appreciated that the floating roof monitoring system 100 can be used to create a monitoring loop or ground loop that includes the monitoring device 102 and the floating roof tank 104. According to various embodiments, the monitoring reel 210, the cable or wire 212, and the monitoring wire 218 are insulated from the shell 200. As such, various embodiments of the concepts and technologies disclosed herein ensure that the intrinsically safe current is routed to the shell 200 via the floating roof 202, and not via the monitoring reel 210, the cable or wire 212, and/or the monitoring wire 218. Although not illustrated in FIG. 2, it should be understood that the floating roof monitoring system 100 can include one or more network connections and/or other devices or connections used to report operating state information to one or more devices, networks, and/or other entities. An illustrative method for using the floating roof monitoring system 100 to monitor the floating roof tank 104 will be described in more detail below with reference to FIG. 3.

Figure 3:
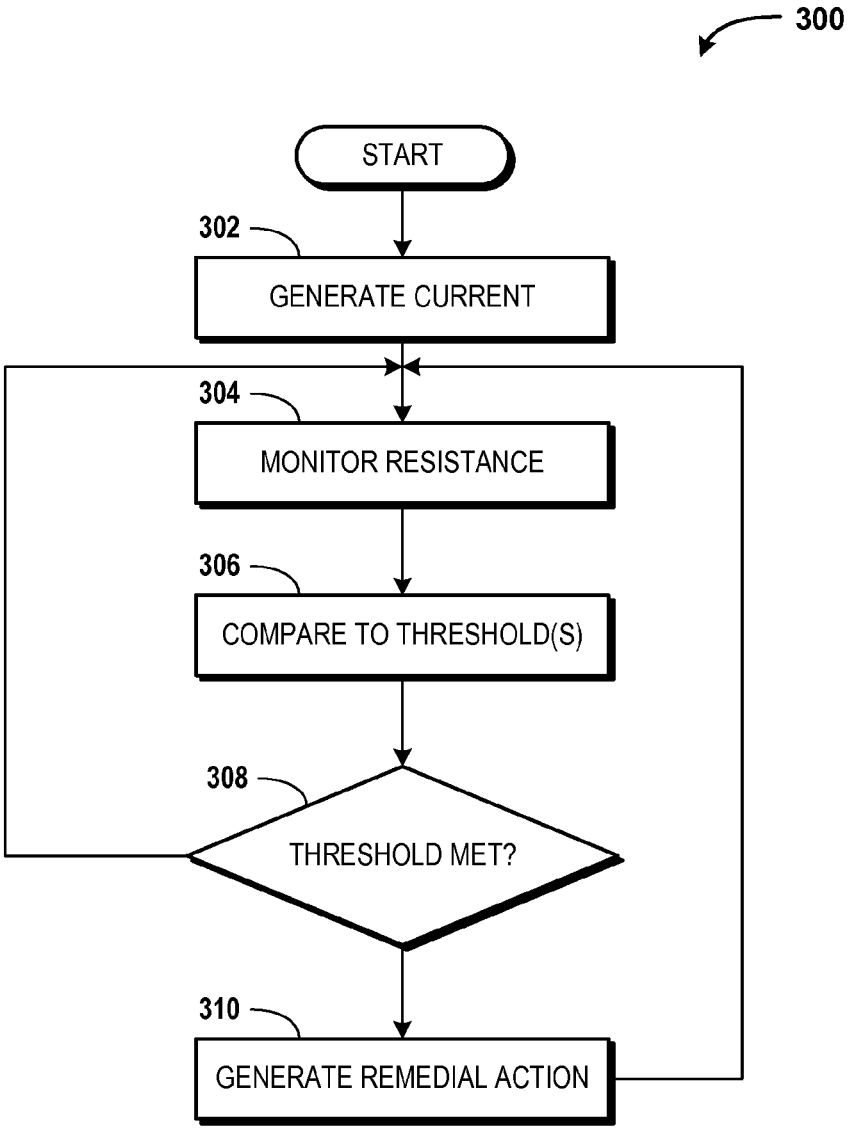
FIG. 3 is a flow diagram illustrating a method of monitoring a floating roof tank, according to one embodiment.

Turning now to FIG. 3, aspects of a method 300 for monitoring a floating roof tank 104 will be described in detail. It should be understood that the operations of the method 300 are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims.

It also should be understood that the illustrated method 300 may be ended after each operation and may not be performed to completion of every operation. Some or all operations of the methods disclosed herein, and/or substantially equivalent operations, can be performed by execution of computer-readable instructions included on a computer-storage media, as defined herein, and/or via execution of logic via various hardware incorporated into one or more logic circuits or other devices. The term "computer-readable instructions," and variants thereof, as used in the description and claims, is used expansively herein to include routines, applications, application modules, program modules, programs, components, data structures, algorithms, and the like. Computer-readable instructions can be implemented on various system configurations, including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within a computing system or another device. The implementation is a matter of choice dependent on the performance and other requirements of the computing system or other device. Accordingly, the logical operations described herein are referred to variously as states, operations, structural devices, acts, or modules. These operations, structural devices, acts, and modules may be implemented in software, in firmware, in special purpose digital logic, in special purpose analog logic or other hardware, and/or in any combination thereof.

For purposes of illustrating and describing the concepts of the present disclosure, the method 300 is described as being performed by the monitoring device 102. As noted above, the monitoring device 102 can include and/or can be configured to execute one or more hardware or software modules including, but not limited to, a monitoring module 106 and/or a reporting module 108. Other devices can provide the functionality described herein via inclusion of hardware modules and/or execution of one or more software modules instead of, or in addition to, the monitoring device 102. Thus, the illustrated embodiments should be understood as being illustrative, and not limiting in any way of the concepts and technologies disclosed herein.

The method 300 begins at operation 302, wherein the monitoring device 102 generates a current. According to some embodiments, the monitoring device 102 generates an intrinsically safe current. An intrinsically safe current is a current that does not pose a risk of fire or explosion in the event of a short circuit or other breakdown at or near flammable or explosive materials. As explained above, the monitoring device 102 can generate a current for testing a monitoring loop or ground loop that includes the monitoring device 102 and a floating roof tank 104. Thus, the current generated at operation 302 can be generated for the monitoring loop or ground loop, and therefore can be used as a test current routed into and through the monitoring loop or ground loop.

From operation 302, the method 300 proceeds to operation 304, wherein the monitoring device 102 monitors a resistance value associated with the monitoring loop or ground loop. As explained above, the resistance value monitored by the monitoring device 102 can correspond to a resistance between a floating roof 202 and a shell 200 of the floating roof tank 104. Thus, the resistance value can correspond to a resistance measured at or near the interface point 208 illustrated in FIG. 2, if desired.

Additionally, or alternatively, the monitoring device 102 can measure a divergence between the measured resistance value and a base or expected resistance value. Thus, the resistance measured at operation 304 can correspond to a value such as a number of Ohms or portions thereof, and/or a rate of divergence such as, for example, a number of Ohms per a measure of time. In some embodiments, the divergence rate is calculated in units of Ohms per second or other units.

From operation 304, the method 300 proceeds to operation 306, wherein the monitoring device 102 compares a measure resistance value to an expected or base resistance value. Additionally, or alternatively, the monitoring device 102 can track measured resistance values. Thus, at operation 306, the monitoring device 102 can calculate a divergence rate between the measured resistance value(s) and an expected or base resistance value. Thus, the monitoring device 102 can be configured to recognize a trending measured resistance value, wherein the trend indicates that the measured resistance value moves away or toward the expected or base resistance value.

From operation 306, the method 300 proceeds to operation 308, wherein the monitoring device 102 determines if one or more of the measured resistance value and/or the calculated divergence value meets or exceeds and/or fails to meet or exceed one or more threshold values. Thus, the monitoring device 102 can compare a difference between the measured resistance value and the expected or base resistance value, and compare the difference to a threshold value. Similarly, a calculated divergence rate can be compared to a threshold value for the divergence rate, if desired.

If the monitoring device 102 determines at operation 308 that a threshold is not met, exceeds, or failed to be met or exceeded, the method 300 returns to operation 304, wherein the monitoring device 102 can again monitor a resistance value associated with the monitoring loop or the ground loop. Although not illustrated in FIG. 3, the measured resistance value and/or the calculated divergence rate can be stored in a data storage device or other structure for use by the monitoring device 102.

If the monitoring device 102 determines, at operation 308, that a threshold is met, exceeded, or failed to be met or exceeded, the method 300 proceeds to operation 310. At operation 310, the monitoring device 102 can generate a remedial action. In some embodiments, the remedial action can include generating the alarm 114 and/or reporting an operation state or other information to one or more devices or entities. In some embodiments, one or more visual, sound, or tactile indicators associated with the monitoring device 102 can be activated or modified to inform one or more entities of the detected condition. In one embodiment, for example, a green LED is activated or maintained as activated at the monitoring device 102 if the monitoring device 102 determines at operation 308 that a threshold is not met. If the monitoring device 102 determines, at operation 308, that the threshold is met, the monitoring device 102 can deactivate the green LED and activate one or more red LEDs. It should be understood that this embodiment is illustrative, and should not be construed as being limiting in any way.

In yet other embodiments, the monitoring device 102 can include various relays and/or other devices that can be triggered via determination at operation 308 that a threshold value is met. Thus, for example, an interlock or pump associated with the floating roof tank 104 can be activated or deactivated by the monitoring device 102 in response to determining that a threshold value is met. In yet other embodiments, the monitoring device 102 can generate messages and/or can be used to trigger message generation such as wired and/or wireless data communications. These and other actions can be triggered by the monitoring device 102. Thus, it should be understood that the monitoring device 102 can be used to trigger various types of actions, and that these actions can be triggered by analog and/or digital logic. From operation 310, the method 300 can return to operation 304. The method 300 can be repeated continuously and/or terminated at any time.

Although not described herein in detail, it should be understood that the monitoring device 102 can be configured to monitor more than one floating roof tank 104. In particular, in some embodiments, the monitoring device 102 is configured to generate intrinsically safe currents for two or more monitoring loops or ground loops, and to monitor resistance values associated with two or more floating roof tanks 104. In some embodiments, for example, the monitoring device 102 pulses current to one or more monitored floating roof tanks 104, and analyzes each resistance value generated via the pulsed current. The monitoring device 102 can pulse currents alternatively to two or more floating roof tanks 104, and thereby monitor two or more floating roof tanks 104. It should be understood that the monitoring device 102 or other devices can make use of time, code, or frequency division technologies to enable monitoring of two or more floating roof tanks 104, if desired.

Similarly, it should be understood that two or more shells 200 associated with two or more floating roof tanks 104 can be electrically coupled or connected to a single grounding bar 206. Thus, in some embodiments, the monitoring device 102 receives signals via a single grounding bar 206, though intrinsically safe currents can be routed or provided to two or more floating roof tanks 104 by the monitoring device 102.

Figure 4:
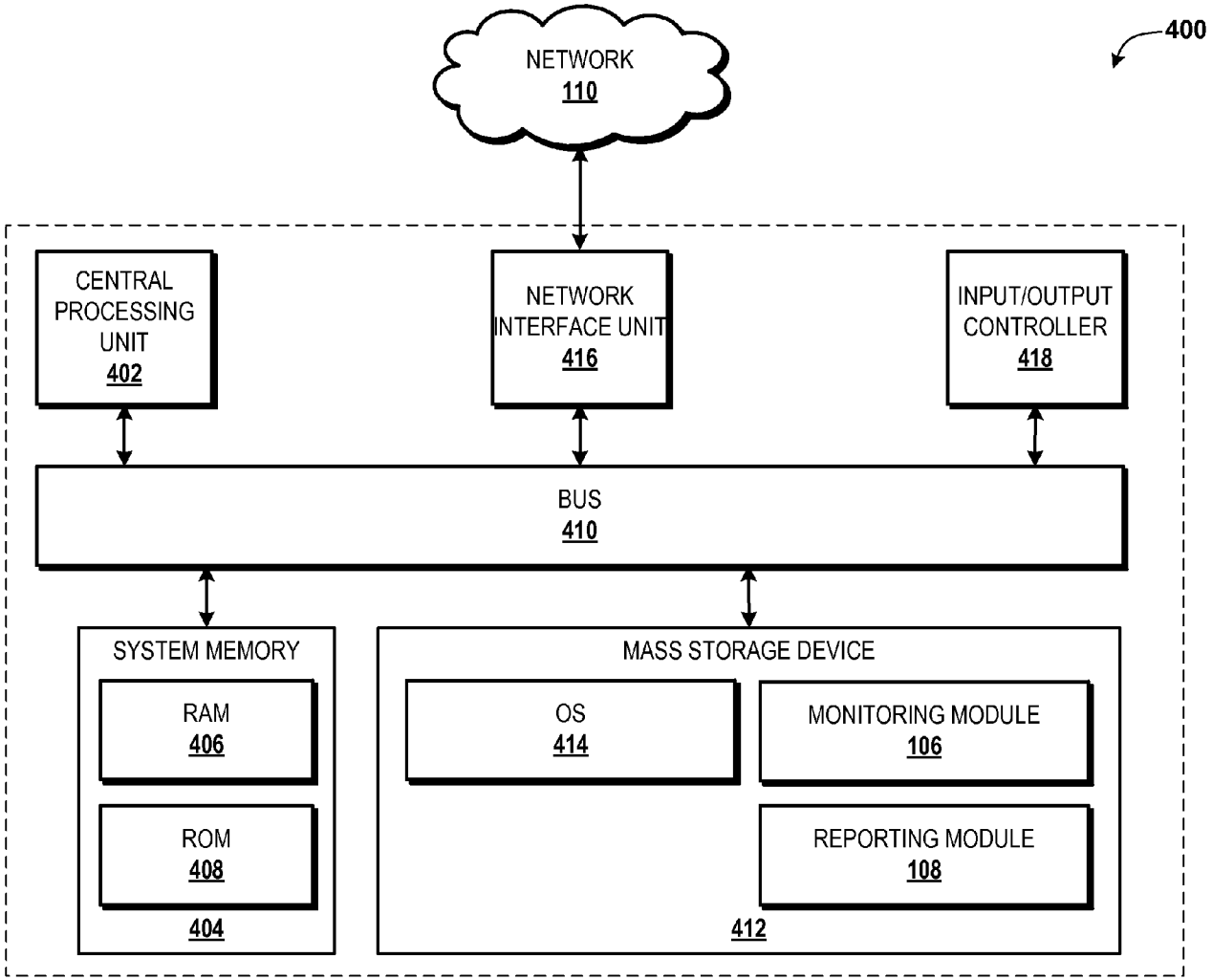
FIG. 4 is a block diagram illustrating a computer hardware and software architecture for a computing system capable of implementing aspects of the embodiments presented herein.

Turning now to FIG. 4, an illustrative computer architecture 400 for a computing device capable of executing software components described herein for monitoring floating roof tanks 104 will be described in detail. The computer architecture 400 shown in FIG. 4 illustrates an embedded control computer, a desktop computer, a laptop computer, a server computer, a cellular telephone, a smart phone, a PDA, combinations thereof, and the like, and can be configured to execute aspects of the software components presented herein. For example, a device having an architecture similar to the computer architecture 400 of FIG. 4 may serve as the monitoring device 102 and/or a device in communication with the monitoring device 102. It should be appreciated that the described software components can also be executed on other example computing environments.

The computer architecture 400 includes a central processing unit 402 (CPU), a system memory 404, which includes a random access memory (RAM) 406 and a read-only memory (ROM) 408, and a system bus 410 that can couple the system memory 404 to the CPU 402. A basic input/output system containing the basic routines that help to transfer information between elements within the computer architecture 400, such as during startup, can be stored in the ROM 408. The computer architecture 400 may further include a mass storage device 412. The mass storage device 412 can store an operating system 414, as well as software, data, and various program modules. In the illustrated embodiment, the mass storage device 412 stores the monitoring module 106 and the reporting module 108. Execution of the monitoring module 106 and the reporting module 108 by the CPU 402 can cause a computing system embodying the computer architecture 400 to provide functionality such as that described above with reference to FIGS. 1-3.

The mass storage device 412 can be connected to the CPU 402 through a mass storage controller (not shown) connected to the bus 410. The mass storage device 412 and its associated computer-readable media can provide non-volatile storage for the computer architecture 400. Although the description of computer-readable media contained herein refers to a mass storage device, such as a hard disk or CD-ROM drive, it should be appreciated by those skilled in the art that computer-readable media can be any available computer storage media or communication media that can be accessed by the computer architecture 400.

Communication media includes computer readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, radio frequency ("RF"), infrared and other wireless media. Combinations of any of the above should also be included within the scope of computer-readable media.

By way of example, and not limitation, computer storage media may include volatile and non-volatile, removable and non-removable media implemented in any method or technology for storage of information such as computer-readable instructions, data structures, program modules or other data. For example, computer media includes, but is not limited to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium which can be used to store the desired information and which can be accessed by the computer architecture 400. For purposes of the claims, the phrase "computer storage medium" and variations thereof, does not include waves, signals, and/or other transitory and/or intangible communication media, per se.

According to various embodiments, a computing system embodying the computer architecture 400 may operate in a networked environment using logical connections to remote computers through a network such as the network 110. The computing system embodying the computer architecture 400 may connect to the network 110 through a network interface unit 416 connected to the bus 410. It should be appreciated that the network interface unit 416 may also be utilized to connect to other types of networks and remote computer systems. The computing system embodying the computer architecture 400 may also include an input/output controller 418 for receiving and processing input from a number of other devices, including a keyboard, mouse, or electronic stylus (not illustrated). Similarly, the input/output controller 418 may provide output to a video display, a printer, or other type of output device (also not illustrated).

As mentioned briefly above, a number of program modules and data files may be stored in the mass storage device 412 and RAM 406 of a computing system embodying the computer architecture 400. The program modules and data files include, but are not limited to, an operating system 414 suitable for controlling the operation of a desktop computer, laptop computer, server computer, mobile telephone, and/or other computing device or environment. The mass storage device 412, ROM 408, and RAM 406 may also store one or more program modules. In particular, the mass storage device 412, the ROM 408, and the RAM 406 may store the monitoring module 106 and/or the reporting module 108 for execution by the CPU 402. The monitoring module 106 and/or the reporting module 108 can include software components for implementing some, all, or none of the method 300 discussed in detail above with reference to FIG. 3. The mass storage device 412, the ROM 408, and the RAM 406 may also store other types of program modules.

Software modules, such as the monitoring module 106 and the reporting module 108 may be associated with the system memory 404, the mass storage device 412, or other data storage. The monitoring module 106 and the reporting module 108 may include software instructions that, when loaded into the CPU 402 and executed, transform a general-purpose computing system into a special-purpose computing system customized to facilitate all, or part of, the techniques for identifying backup coverage in a wireless network as disclosed herein. As detailed throughout this description, the program modules may provide various tools or techniques by which a computing system embodying the computer architecture 400 may participate within the overall systems or operating environments using the components, logic flows, and/or data structures discussed herein.

The CPU 402 may be constructed from any number of transistors or other circuit elements, which may individually or collectively assume any number of states. More specifically, the CPU 402 may operate as a state machine or finite-state machine. Such a machine may be transformed to a second machine, or specific machine by loading executable instructions contained within the program modules. These computer-executable instructions may transform the CPU 402 by specifying how the CPU 402 transitions between states, thereby transforming the transistors or other circuit elements constituting the CPU 402 from a first machine to a second machine, wherein the second machine may be specifically configured to support real time event driven energy management. The states of either machine may also be transformed by receiving input from one or more user input devices associated with the input/output controller 418, the network interface unit 416, other peripherals, other interfaces, or one or more users or other actors. Either machine may also transform states, or various physical characteristics of various output devices such as printers, speakers, video displays, or otherwise.

Encoding of the program modules may also transform the physical structure of the storage media. The specific transformation of physical structure may depend on various factors, in different implementations of this description. Examples of such factors may include, but are not limited to: the technology used to implement the storage media, whether the storage media are characterized as primary or secondary storage, and the like. For example, if the storage media are implemented as semiconductor-based memory, the program modules may transform the physical state of the system memory 404 when the software is encoded therein. For example, the software may transform the state of transistors, capacitors, or other discrete circuit elements constituting the system memory 404.

As another example, the storage media may be implemented using magnetic or optical technology. In such implementations, the program modules may transform the physical state of magnetic or optical media, when the software is encoded therein. These transformations may include altering the magnetic characteristics of particular locations within given magnetic media. These transformations may also include altering the physical features or characteristics of particular locations within given optical media, to change the optical characteristics of those locations. It should be appreciated that various other transformations of physical media are possible without departing from the scope and spirit of the present description.

Based on the foregoing, it should be appreciated that a floating roof monitoring system has been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A floating roof monitoring system comprising:

a floating roof tank comprising a floating roof and a shell, the floating roof tank being conductively connected to a grounding device; and a monitoring device conductively connected to the grounding device and the floating roof tank, the monitoring device being configured to:

generate a current for a monitoring loop comprising electrical connections between the monitoring device, the floating roof tank, and the grounding device;

monitor a resistance value associated with the floating roof tank; and determine if a remedial action is to be taken based, at least partially, upon the resistance value.

2. The floating roof monitoring system of claim 1, wherein the current comprises an intrinsically safe current.

3. The floating roof monitoring system of claim 1, wherein the resistance value corresponds to a resistance between the floating roof and the shell.

4. The floating roof monitoring system of claim 1, wherein the monitoring device is further configured to determine a difference between the resistance value and an expected resistance value associated with the floating roof tank.

5. The floating roof monitoring system of claim 4, wherein the monitoring device is further configured to:

compare the difference determined with a threshold difference value; and determining if the threshold difference value is satisfied by the difference determined.

6. The floating roof monitoring system of claim 5, wherein the monitoring device is further configured to take the remedial action in response to determining that the threshold difference value is satisfied.

7. The floating roof monitoring system of claim 5, wherein determining that the threshold difference value is satisfied comprises at least one of:

determining that the difference value determined exceeds the threshold difference value;

determining that the difference value determined equals the threshold difference value;

determining that the difference value determined does not equal the threshold difference value; or determining that the difference value determined is less than the threshold difference value.

8. The floating roof monitoring system of claim 1, wherein the monitoring device is further configured to:

determine a divergence rate between the resistance value and an expected resistance value associated with the floating roof tank;

compare the divergence rate to a threshold divergence rate; and take the remedial action in response to determining that the divergence rate exceeds the threshold divergence rate.

9. The floating roof monitoring system of claim 1, wherein the monitoring loop further comprises a remote input/output device.

10. The floating roof monitoring system of claim 1, wherein the monitoring loop further comprises a monitoring reel disposed at the shell and a monitoring cable disposed between the monitoring reel and the floating roof, and wherein the current passes through the monitoring cable and into the floating roof.

11. The floating roof monitoring system of claim 1, further comprising a networking device associated with the monitoring device, the networking device being used to provide data communications between the monitoring device and a device remote from the monitoring device.

12. The floating roof monitoring system of claim 1, wherein the monitoring device further comprises a visual indicator for visually indicating an operation state associated with the monitoring device.

13. A method for monitoring a floating roof tank, the method comprising:

generating, at a monitoring device, a current for a monitoring loop comprising electrical connections between the monitoring device, a floating roof tank comprising a floating roof and a shell, and a grounding device;

monitoring a resistance value associated with the floating roof tank, the resistance value being determined for at least one point along the monitoring loop; and determining if an action is to be taken based, at least partially, upon the resistance value.

14. The method of claim 13, further comprising:

determining an expected resistance value associated with the floating roof tank; and determining a difference between the resistance value and the expected resistance value.

15. The method of claim 14, further comprising determining a threshold difference value between the resistance value and the expected resistance value.

16. The method of claim 15, further comprising:

comparing the difference determined with the threshold difference value; and determining if the threshold difference value is satisfied by the difference determined.

17. The method of claim 16, wherein determining that the threshold difference value is satisfied comprises at least one of:

determining that the difference value determined exceeds the threshold difference value; or determining that the difference value determined equals the threshold difference value.

18. The method of claim 17, wherein the threshold difference value is about ten Ohms.

19. The method of claim 13, wherein the current comprises an intrinsically safe current, and the action comprises generating an alarm.

20. A method for monitoring a floating roof tank, the method comprising:

generating, at a monitoring device, an intrinsically safe current for a monitoring loop, the monitoring loop comprising electrical connections between the monitoring device and a remote input/output device, between the remote input/output device and a floating roof tank comprising a floating roof and a shell, and between the remote input/output device and a grounding device electrically connected to the floating roof tank;

determining an expected resistance value associated with the floating roof tank, the expected resistance value corresponding to a resistance expected for at least one point along the monitoring loop;

monitoring a measured resistance value associated with the floating roof tank, the measured resistance value being obtained for the at least one point along the monitoring loop;

determining a difference between the measured resistance value and the expected resistance value;

comparing the difference determined with a threshold difference value;

determining if the threshold difference value is satisfied by the difference determined; and taking an action based, at least partially, upon determining that the threshold difference value is satisfied.

* * * * *